US008495781B2

(12) United States Patent
Dingert

(10) Patent No.: US 8,495,781 B2
(45) Date of Patent: Jul. 30, 2013

(54) CLEANING DEVICE

(75) Inventor: Uwe Dingert, Abtsteinach (DE)

(73) Assignee: Carl Freudenberg KG, Weinheim (DE)

( * ) Notice: Subject to any disclaimer, the term of this patent is extended or adjusted under 35 U.S.C. 154(b) by 386 days.

(21) Appl. No.: 12/808,864

(22) PCT Filed: Dec. 17, 2008

(86) PCT No.: PCT/EP2008/010749

§ 371 (c)(1),
(2), (4) Date: Jun. 17, 2010

(87) PCT Pub. No.: WO2009/077169

PCT Pub. Date: Jun. 25, 2009

(65) Prior Publication Data

US 2010/0306939 A1 Dec. 9, 2010

(30) Foreign Application Priority Data

Dec. 18, 2007 (DE) ..... 10 2007 061 607

(51) Int. Cl.
*A47L 11/00* (2006.01)

(52) U.S. Cl.
USPC ..... 15/50.3; 15/52.1; 15/320

(58) Field of Classification Search
USPC ..... 15/41.1, 44, 50.1, 50.3, 51, 52, 52.1, 15/320, 403, 340.1
See application file for complete search history.

(56) References Cited

U.S. PATENT DOCUMENTS

| | | | | |
|---|---|---|---|---|
| 977,701 | A | 12/1910 | Broberg | |
| 1,644,189 | A | 10/1927 | Hendricks | |
| 1,687,283 | A | 10/1928 | Deutscher | |
| 3,761,991 | A | 10/1973 | Moss | |
| 5,500,979 | A * | 3/1996 | Worwag | 15/349 |
| 5,697,119 | A | 12/1997 | Mussalo | |
| 6,009,594 | A * | 1/2000 | Grey | 15/322 |
| 6,966,098 | B2 * | 11/2005 | Sako et al. | 15/364 |
| 8,020,236 | B2 * | 9/2011 | Kaleta et al. | 15/4 |
| 2001/0027586 | A1 * | 10/2001 | Lee | 15/377 |
| 2002/0184723 | A1 * | 12/2002 | Bishop | 15/118 |
| 2003/0126709 | A1 * | 7/2003 | Policicchio et al. | 15/228 |
| 2003/0163884 | A1 * | 9/2003 | Weihrauch | 15/207.2 |
| 2003/0204923 | A1 | 11/2003 | Nakamura | |

(Continued)

FOREIGN PATENT DOCUMENTS

| | | | |
|---|---|---|---|
| DE | 8902813 | U1 | 6/1989 |
| DE | 4208094 | A1 | 9/1993 |

(Continued)

OTHER PUBLICATIONS

Definition of "sponge" from dictionary.com found at: http://dictionary.reference.com/browse/sponge.*

(Continued)

*Primary Examiner* — Brian Glessner
*Assistant Examiner* — Brian D Mattei
(74) *Attorney, Agent, or Firm* — Leydig, Voit & Mayer, Ltd.

(57) ABSTRACT

A cleaning device for cleaning a floor includes a base body, a rotatable roller brush disposed on the base body, a dirt container disposed on the base body, a liquid container configured to receive a cleaning liquid disposed on the base body; and a sponge configured to receive a soiled cleaning liquid disposed on the base body.

19 Claims, 8 Drawing Sheets

U.S. PATENT DOCUMENTS

| | | | | |
|---|---|---|---|---|
| 2005/0155631 | A1* | 7/2005 | Kilkenny et al. | 134/6 |
| 2005/0160546 | A1* | 7/2005 | Weihrauch | 15/207.2 |
| 2007/0099549 | A1* | 5/2007 | Palushaj | 451/41 |
| 2009/0044351 | A1 | 2/2009 | Menrik et al. | |

FOREIGN PATENT DOCUMENTS

| | | | |
|---|---|---|---|
| DE | 102006038498 | A1 | 2/2008 |
| EP | 1857035 | A1 | 11/2007 |
| GB | 446303 | A | 4/1936 |
| WO | WO 2005087075 | A1 | 9/2005 |
| WO | WO 2007025012 | A1 | 3/2007 |

OTHER PUBLICATIONS

International Search Report for PCT/EP2008/010749 mailed on Jul. 24, 2009.

* cited by examiner

CLEANING DEVICE

CROSS REFERENCE TO PRIOR APPLICATIONS

This application is a U.S. National Phase application under 35 U.S.C. §371 of International Application No. PCT/EP2008/010749, filed Dec. 17, 2008, which claims priority to German Application No. DE 10 2007 061 607.6, filed Dec. 18, 2007. The International Application was published in German on Jun. 25, 2009 as WO 2009077169 under PCT Article 21 (2).

FIELD

The invention relates to a cleaning device, comprising a base body, on which a rotatable roller brush, a dirt container, a liquid container for receiving cleaning liquid and a mechanism for receiving soiled cleaning liquid are arranged.

BACKGROUND

A cleaning device of this type is known from WO 2005/087075. The previously known cleaning device consists of a base body, on which a rotatable roller brush which is driven by an electric motor is fastened, said brush transporting the collected dirt into a dirt container arranged behind the roller brush. Coarse dirt is received by the roller brush and is collected and retained by the dirt container. Fine dirt, in particular dust, can pass through the roller brush and is received by the cleaning cloth arranged therebehind, which is fastened to a cloth holder. This improves the cleaning action compared to a cleaning device with just a roller brush. The cleaning action is additionally improved in that integrated in the cloth holder is a liquid container, by means of which the cleaning liquid can be applied directly or indirectly to the cloth. Fine dust-like particles are also bound by the cleaning liquid and can be received by the cleaning cloth. The cleaning cloth has a rigid plate which faces the floor to be cleaned and the cloth clamped on the cloth holder only has a small thickness in the range of a few millimetres. Because of the rigid plate and the thin cloth, the cleaning action is reduced on uneven floors, for example tiles. Furthermore, the cloth only has a small water absorption capacity because of the small volume.

SUMMARY OF THE INVENTION

An aspect of the present invention includes developing the known cleaning device in such a way that the cleaning performance, in particular on uneven floors, is further improved.

In an embodiment, the mechanism is configured in such a way that it can absorb a much larger amount of cleaning liquid. In addition, the mechanism may be configured as a cloth or as a body with a three-dimensional extent. To increase the liquid absorption capacity, the mechanism may be equipped with hydrophilic components. Components of this type are, for example super-absorbers, zeolites, silicates or chemical drying agents. The mechanism is preferably configured as a sponge. In this case, the sponge is configured, in particular, as an open-cell sponge, for example made of polyurethane. Sponges of this type, because of their porosity, have a high water absorption capacity, which may be more than three times the sponge's own weight. The sponge can be integrated particularly easily into the base body and also consists of only one part. The porosity of the sponge also allows dirt to be received by capillary forces. This means that the dirt particles do not only adhere to the surface of the sponge, but are also transported into the sponge and are thereby better bound. These dirt particles are only released and rinsed out by rinsing and wringing out the sponge. The sponge also has a flexible form and may thus be adapted to the structure of the floor to be cleaned. Thus, it is possible for the sponge, for example, to also penetrate into joints of tile coverings and to receive dirt and liquid there. The mechanism, which is arranged behind the roller brush, receives the remainder of the cleaning liquid, to which dirt has been added and has not been conveyed into the dirt container. This liquid only still has relatively small particles, which are also received by the sponge. Behind the sponge, only a small amount of moisture still remains on the floor to be cleaned. To integrate a sponge into the base body, all that is necessary is a type of shaft into which the sponge is pushed. Fastening elements may be dispensed with, as the sponge is non-positively fixed in the shaft by restoring forces of the sponge. In an advantageous configuration, the mechanism may be multi-part. In this case, two sponge bodies may be provided which are connected to one another by a hook-and-loop connection. In this case, it is advantageous for the sponge portion, which faces the floor to be cleaned and accordingly wears out more quickly, to be able to be exchanged separately.

The mechanism may be provided with a covering on the side facing the floor to be cleaned. The covering may, in this case, be configured as a nonwoven or as a woven fabric. A covering, which is formed from microfibers, is particularly advantageous. Microfibers have a good water absorption capacity and can simultaneously receive aqueous and fatty soiling. Coverings of this type guide the moisture through and are more wear-resistant relative to translatory movements compared to a sponge which comes into direct contact with the floor to be cleaned. The covering may be exchangeably fastened to the mechanism. For this purpose, the covering may be fastened to the mechanism, for example by means of a hook-and-loop connection. Disposable cloths made of nonwoven, in particular, may be fastened in this manner. It is also conceivable for the sponge with the covering to be configured as a disposable product.

The mechanism may have recesses or openings, into which projections connected to the base body can project. These projections, ideally made of rigid plastics material, with compression of the mechanism, can be brought into indirect contact with the floor to be cleaned by means of the mechanism and thus improve the cleaning performance in the case of ingrained dirt. In order to be able to compress the mechanism, the wheels, which guide the cleaning device in the region of the mechanism, may be height adjustable in a spring-loaded manner, so the pressure on the mechanism can be gauged by the user.

The base body, on the side facing the floor to be cleaned, may have a slot-shaped opening, through which the mechanism projects in such a way that it comes into contact with the floor to be cleaned. In this case, the mechanism has a width, which corresponds to the width of the roller brush. Furthermore, the mechanism may thus be particularly easily stored. Furthermore, the mechanism may have a projection, which projects through the opening. In this case, the projection may be configured such that the mechanism is pressed with biasing onto the floor to be cleaned. This produces a height compensation, by means of which the cleaning performance is further improved, in particular in the case of uneven floors.

The mechanism may be removable from the cleaning device. For this purpose, the mechanism may be removable, for example, upwardly or to one side, in order to be able to wring out the mechanism after it has been saturated with liquid or to be able to exchange it.

The dirt container may be removable. For this purpose, the dirt container may be guided in a drawer-like manner in the base body or be lockable from the upper side, the side remote from the floor to be cleaned, in the base body. In this case, the dirt may be removed particularly easily from the cleaning device.

The liquid container may be connected to the roller brush in such a way that the cleaning liquid can be applied to the roller brush. The cleaning liquid, which is applied directly to the roller brushes, on the one hand brings about a continuous cleaning of the roller brush and, on the other hand, the dirt to be swept up is immediately moistened, so the latter combines with the cleaning liquid. In contrast to dry cleaning, in which the dust can be swirled up by the roller brush, the dust is bound in the solution according to the invention and can no longer be swirled up. The cleaning liquid may be conveyed, in this case, by a pump onto the roller brush, which allows particularly effective cleaning of the roller brush, or may be conveyed by gravitational force onto the roller brush, which is particularly economical. Furthermore, it is advantageous that even ingrained dirt can be released by the roller brush wetted with cleaning liquid, so the cleaning device has an improved cleaning performance overall. It is also conceivable to provide a modular cleaning device, which consists only of the base body with the roller brush, the liquid container and dirt container, the base body having an adapter for connection of the cleaning device to a conventional flat mop. Thus, the cleaning device may optionally be connected to a flat mop.

A pump may be provided, which is only switched on temporarily. A permanently driven pump results in high power consumption, although the pump performance is not necessary at all times. With liquid transportation that is based on gravitational force alone, the line and nozzle system may clog up owing to deposits due to low pressure and low volume flow. These impurities may be rinsed out of the line and nozzle system by temporarily switching on the pump and thereby increasing the pressure and volume flow. Furthermore, the roller brush may be cleaned off by a temporary strong liquid flow. It is conceivable to select a combination of gravitational force drive and pump drive or a pure pump drive with a temporarily connected pump. In this case, it is also conceivable for the pump to be time-controlled, in other words it works in a predetermined cycle or is activated manually by activating a switch integrated in the handle. The pump may be driven by a toothed belt, so only one electric motor is required to drive the roller brush and pump.

The roller brush may comprise bristles, which consist of a material with a small water absorption capacity. Materials of this type are, in particular, plastics materials from the group of polypropylenes and polybutylene terephthalate. As the bristles of the roller brush of the cleaning device according to the invention, in contrast to conventional cleaning devices, come into contact with water, the bristles with a small water absorption capacity have a longer period service life.

Some bristles of the roller brush may be configured as a wear indicator. For this purpose, some bristles may be provided with a dye, which gradually dissolves in contact with water and thereby indicates the wear of the roller brush.

At least some of the bristles of the roller brush may be treated with an antibacterial agent. Treatment of this type, for example, involves coating the bristles with a silver-containing material. This treatment is advantageous, in particular, because the roller brush comes into contact with liquid and dirt and it is not possible to thoroughly clean the roller brush manually.

The roller brush may be mounted in the base roller in such a way that it can be vertically displaced. In addition, the roller brush may be spring-loaded, so the roller brush always rests with a primary pressure on the floor to be cleaned. Depending on the wear of the bristles, the roller brush is readjusted by vertical displacement and always remains in contact with the floor to be cleaned.

The cleaning device may comprise a handle, on which the liquid container is arranged. As a result, the liquid container is mounted higher and the liquid reaches the roller brush under a higher pressure. This is particularly advantageous when a pump means is dispensed with for cost reasons. A liquid container arranged here may be bottle-shaped and thus be particularly easy to exchange. It is also possible for a receiver for liquid containers to be arranged on the handle, the receiver comprising a thread, for example, and it being possible to fasten any liquid containers, for example bottles with detergents to said receiver.

The mechanism may be operatively connected to the dirt container. During the cleaning process, a mixture of liquid and solid components collects in the dirt container. It is disadvantageous here for the liquid components to be able to be spilt when the cleaning device is tilted. In the advantageous configuration, the dirt container is connected to the mechanism in such a way that liquid components can be received by the mechanism and only solid components remain in the dirt container. In this case, the liquid is bound in the mechanism in such a way that it is not possible to spill the liquid components.

A perforated partition may be arranged between the mechanism and the dirt container. In this configuration, a sieve-like connection is produced between the mechanism and the dirt container, through which the liquid components can arrive from the dirt container into the mechanism. In other configurations it is also conceivable that a filter medium, for example a nonwoven layer, is arranged between the mechanism and dirt container. The filter medium ensures that as far as possible only low-particle liquid arrives in the mechanism and is bound there.

BRIEF DESCRIPTION OF THE DRAWINGS

Some embodiments of the cleaning device according to the invention will be described in more detail below with the aid of the figures, in which, schematically in each case.

DETAILED DESCRIPTION

Figure 1:
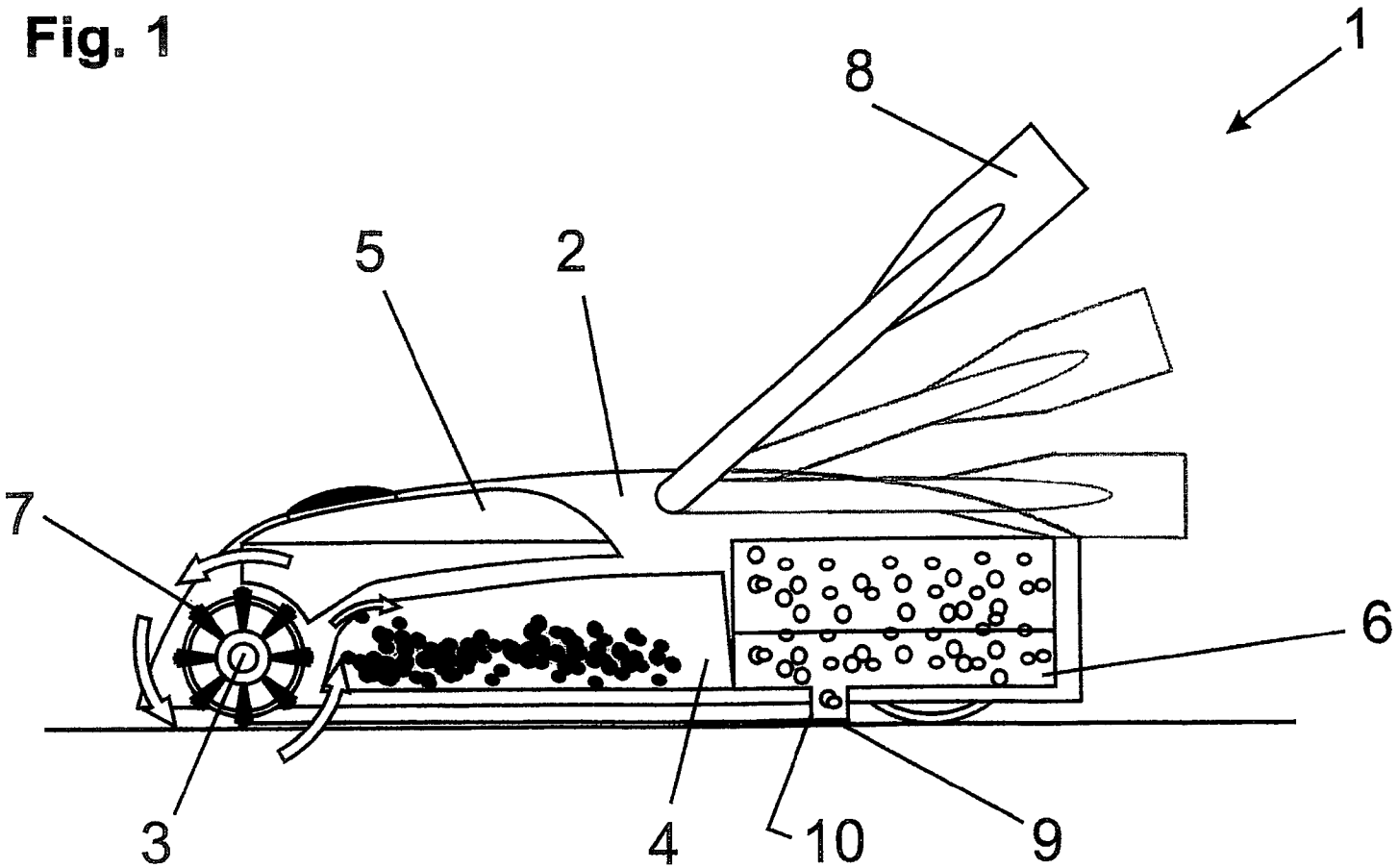
FIG. 1 shows a first embodiment of the cleaning device.

FIG. 1 shows a cleaning device 1, consisting of a base body 2, on which a handle 8 is fastened by means of an articulated joint. A motor-driven rotatable roller brush 3, by means of which dirt is conveyed into the dirt container 4 arranged behind the roller brush 3, is arranged in the front part of the base body 2. The roller brush 3 is driven by a battery-operated electric motor, lithium-ion batteries preferably being used as the batteries. Furthermore, the base body 2 contains a liquid container 5 to receive cleaning liquid. The liquid container 5 is arranged in such a way that the cleaning liquid can be applied directly to the roller brush 3. For this purpose, a pump may also be connected between the liquid container 5 and roller brush 3 which increases the liquid pressure and thus improves the cleaning action. In other configurations, the liquid container may also be arranged in the handle 8. A mechanism 6 to receive soiled cleaning liquid is located behind the roller brush 3 and behind the dirt container 4. The mechanism 6 in this configuration consists of an open-cell polyurethane foam and, on the side facing the floor to be cleaned, has a covering 9, consisting of a nonwoven. The base body 2 has a slot-shaped opening 10, through which the mechanism 6 projects in such a way that it comes into contact with biasing with the floor to be cleaned. The width of the mechanism 6 substantially corresponds to the width of the roller brush 3. The mechanism 6 can be laterally removed from the base body 2. The roller brush 3 comprises bristles 7, which consist of a material with a small water absorption capacity. In this configuration, polypropylene was selected as the material of this type. Some bristles 7 were provided with a dye, which fades or is washed out over time. These bristles 7 serve as indicator bristles and indicate when the roller brush 3 should be exchanged. Furthermore, at least some of the bristles 7 are treated with an antibacterial agent. In this case, the bristles 7 may be coated with a silver-containing material. Some of the bristles 7 may also be formed from a multi-layer nonwoven. These bristles 7 may be combined with bristles 7, which consist of an elastomeric material. The roller brush 3 is mounted in the base body 2 in such a way that it can be vertically displaced. Furthermore, the roller brush 3 is pressed by the force of a spring onto the floor to be cleaned. It is thus ensured that the bristles 7, even after shortening due to wear, always come into contact with the floor to be cleaned.

Figure 2:
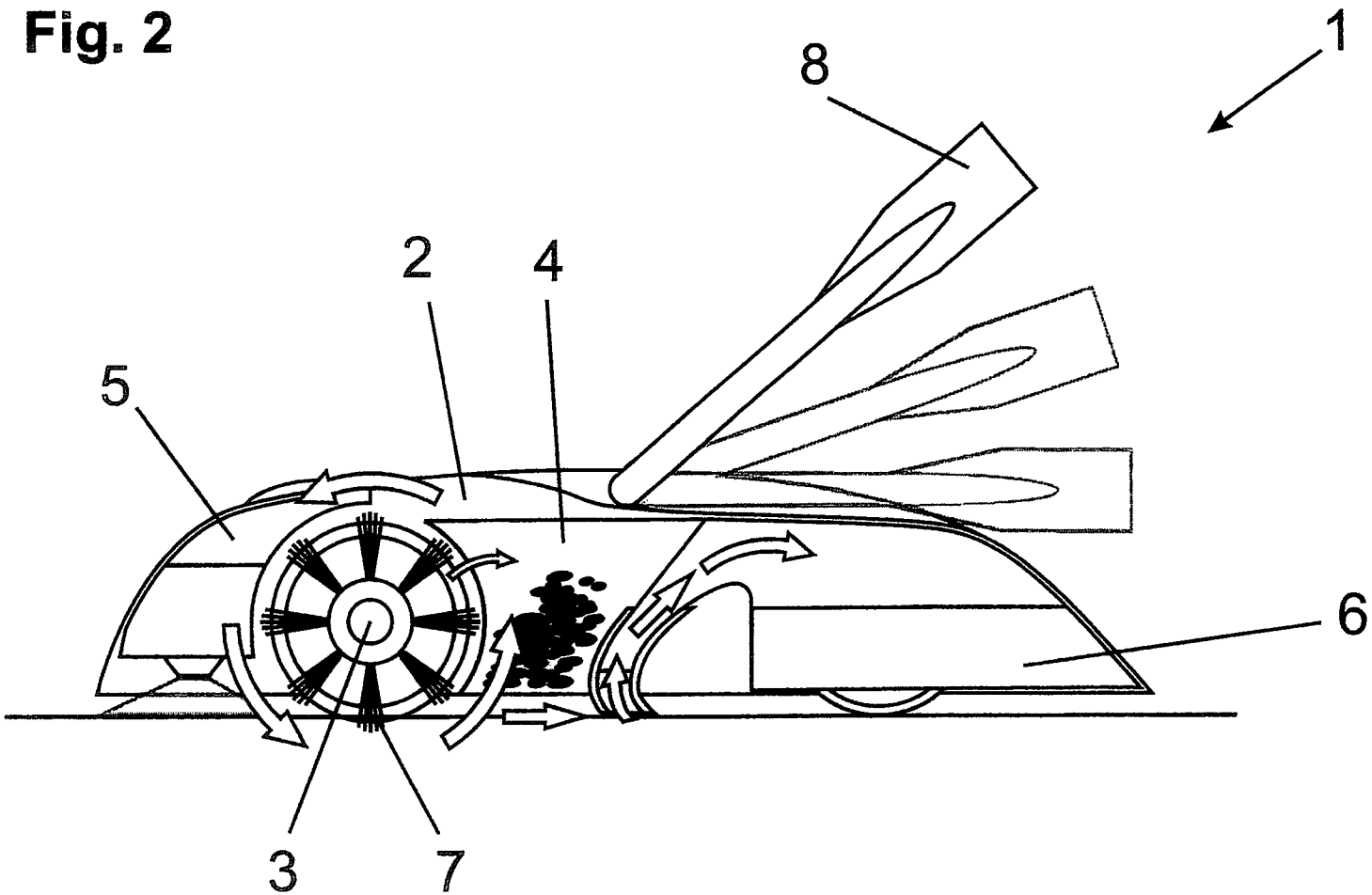
FIG. 2 shows a second embodiment of the cleaning device.

FIG. 2 shows cleaning device 1, consisting of a base body 2, to which a handle 8 is fastened by means of an articulated joint. Arranged in the front part of base body 2 is a motor-driven rotatable roller brush 3, by means of which dirt is conveyed into the dirt container 4 arranged behind the roller brush 3. Furthermore, the base body 2 contains a liquid container 4 to receive cleaning liquid. The liquid container 5 is arranged in such a way that the cleaning liquid can be applied in the cleaning direction directly in front of the roller brush 3 onto the floor to be cleaned. Located behind the roller brush 3 and behind the dirt container 4 is a mechanism 6 to receive soiled cleaning liquid. The mechanism 6 in this configuration consists of a suction means, comprising one or more suction nozzles, a conveying mechanism and a dirt container. Furthermore, the mechanism may contain an exhaust air filter. The roller brush 3 comprises bristles 7, which consist of a material with a small water absorption capacity. Propylene was selected in this embodiment as the material of this type. Some bristles 7 were provided with a dye, which fades or is washed out over time. These bristles 7 serve as indicator bristles and indicate when the roller brush 3 should be exchanged.

Furthermore, at least some of the bristles 7 are treated with an antibacterial agent. For this purpose, the bristles 7 may be coated with a silver-containing material. The roller brush 3 is mounted in the base body 2 in such a way that it is vertically displaceable. Furthermore, the roller brush 3 can be pressed by the force of a spring onto the floor to be cleaned. It is thus ensured that the bristles 7, even after shortening due to wear, always come into contact with the floor to be cleaned.

Figure 3:
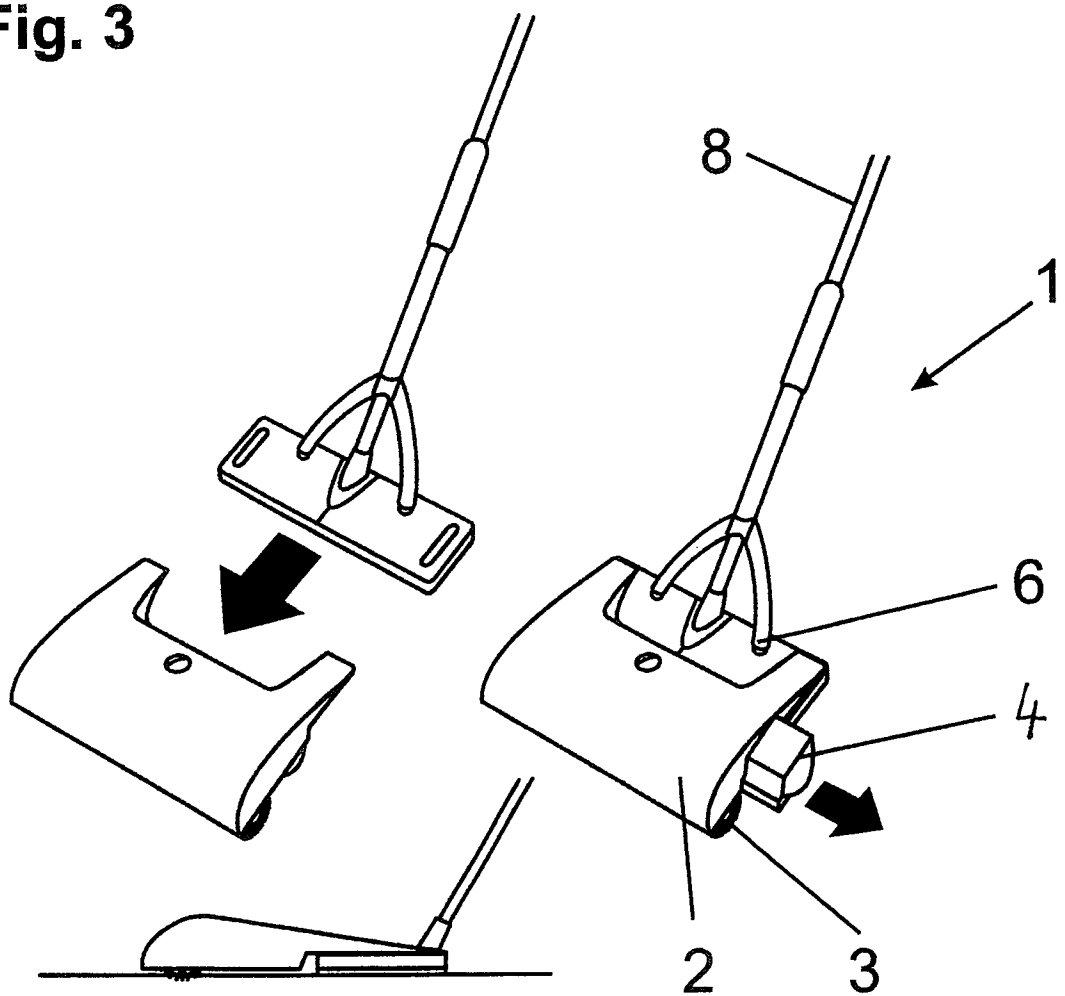
FIG. 3 shows an embodiment of the cleaning device adaptable for connection to a mop.

FIG. 3 shows a cleaning device 1, consisting of a base body 2, in which a motor-driven rotatable roller brush 3 is arranged at the front, by means of which dirt is conveyed into the dirt container 4 arranged behind the roller brush 3. Furthermore, the base body 2 contains a liquid container 5 for receiving cleaning liquid. The liquid container 5 is arranged in such a way that the cleaning liquid can be applied directly to the roller brush 3. The base body 2 also comprises an adapter by means of which the cleaning device can be connected to a conventional flat mop, in particular a butterfly mop. The roller brush 3 may correspond to a roller brush 3 described according to one of the previous figures.

Figure 4:
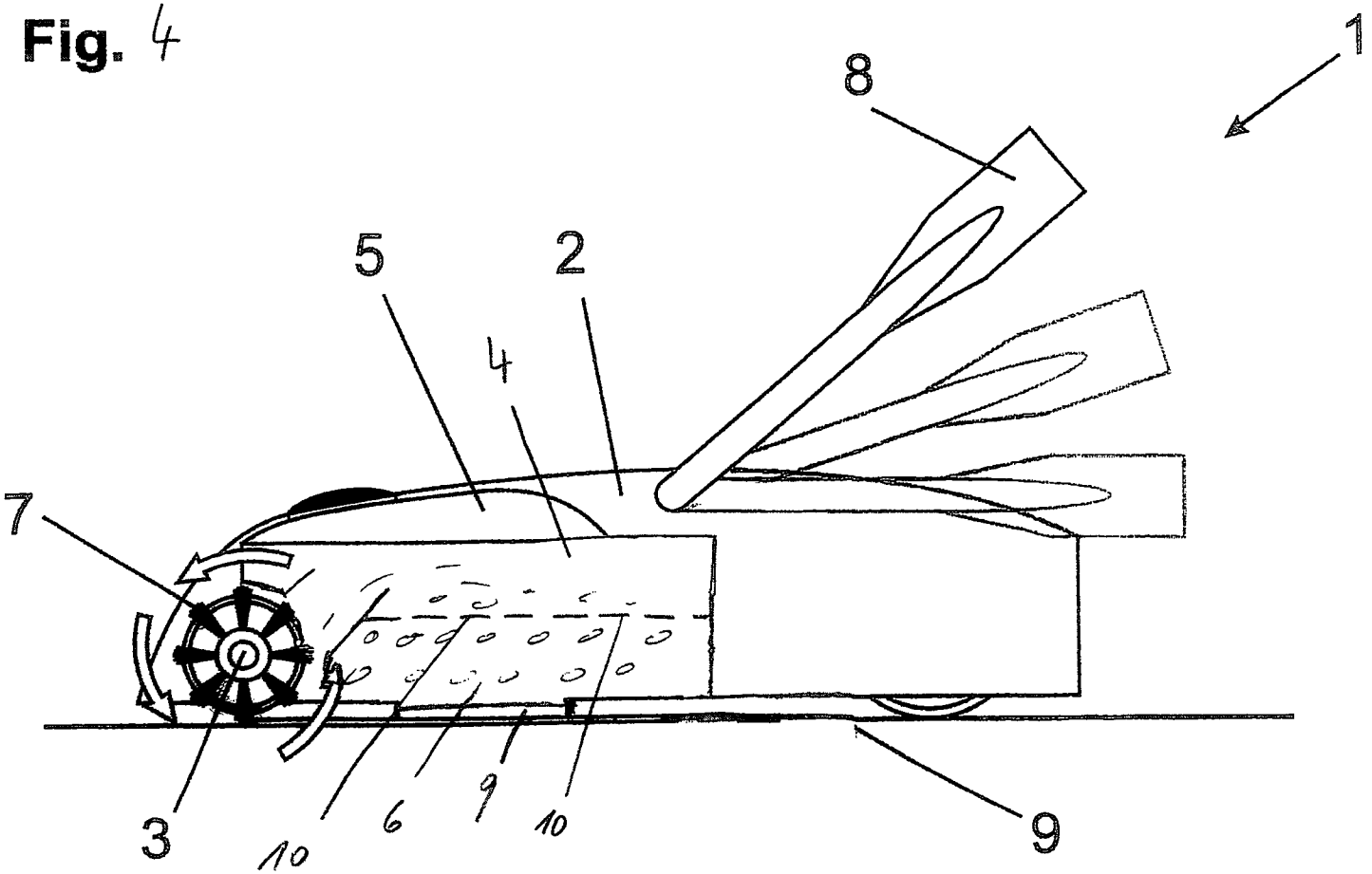
FIG. 4 shows the cleaning device with a connection between the mechanism and dirt container.

FIG. 4 shows a cleaning device 1 according to FIG. 1, in which, in this configuration, the mechanism 6 and the dirt container 4 are arranged one above the other and are operatively connected to one another, in that the partition 10 is perforated in the manner of a sieve between the mechanism 6 and dirt container 4. The covering 9, in this configuration, is rigidly connected to the sponge and contains microfibers.

Figure 5:
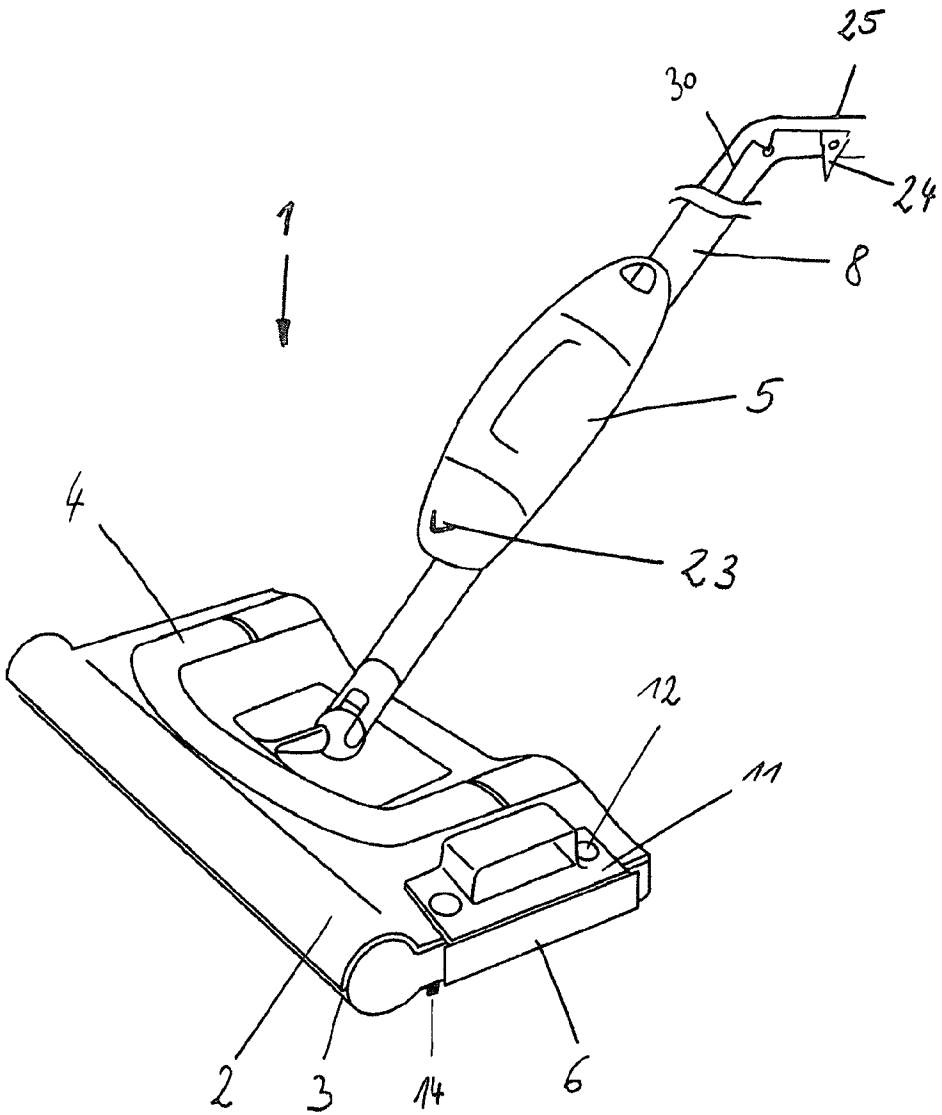
FIG. 5 shows a cleaning device with a mop cover directly fastened by means of snap fasteners.
Figure 5:
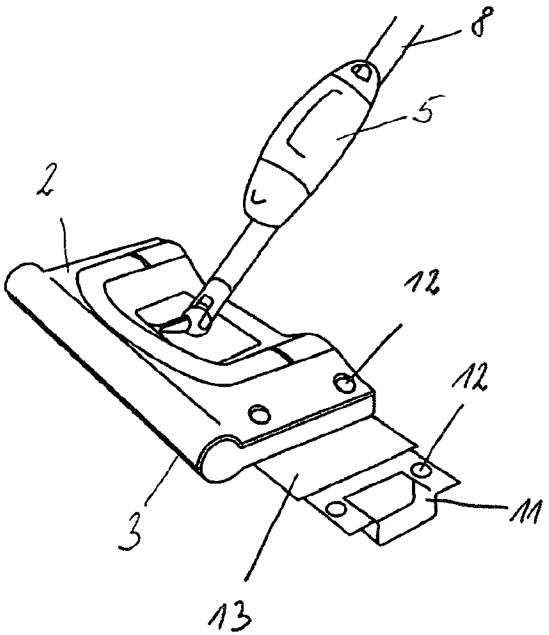

FIG. 5 shows a cleaning device 1, consisting of a base body 2, to which a handle 8 is fastened by means of an articulated joint. Arranged in the front part of the base body 2 is a motor-driven rotatable roller brush 3, by means of which dirt is conveyed into the dirt container 4 arranged behind the roller brush 3. The roller brush 3 is driven by a battery-operated electric motor, lithium-ion batteries preferably being used as batteries. A mechanism 6 for receiving soiled cleaning liquid is located behind the roller brush 3 and behind the dirt container 4. In this configuration, the mechanism 6 consists of a conventional commercial mop cover 13 for flat mops. The mop cover 13 is configured in such a way that, at the two narrow sides, it has a lug 11, which is provided with snap fasteners 12. To fasten the mop cover 13, snap fasteners 12 are also attached to the base body 2, to which snap fasteners the snap fasteners 12 of the mop cover 13 can be fastened. In this configuration, the mop cover 13 is thus directly fastened to the base body 2. It is advantageous in this configuration that the mop covers 13 can be fastened directly to the cleaning device 1. Furthermore, the mop covers can be fastened directly to the base body 2, so a separate cloth holder can be dispensed with. The brush roller 3 comprises bristles 7, which consist of a material with a small water absorption capacity. Polypropylene was selected as the material of this type in this configuration. Some bristles 7 were provided with a dye, which fades or is washed out over time. These bristles 7 serve as indicator bristles and indicate when the roller brush 3 should be exchanged. Furthermore, at least some of the bristles 7 may be treated with an antibacterial agent. For this purpose, the bristles 7 may be coated with a silver-containing material. Some of the bristles 7 may also be formed from a multi-layer nonwoven. These bristles 7 may be combined with bristles 7, which consist of an elastomeric material. The roller brush 3 is mounted in this base body 2 in such a way that it is vertically displaceable. Furthermore, the roller brush 3 is pressed by the force of a spring onto the floor to be cleaned. It is thus ensured that the bristles 7, even after shortening due to wear, always come into contact with the floor to be cleaned. The base body 2, on the side facing the floor to be cleaned, is also provided with sliding bodies 14 which, in this configuration, substantially consist of bristles. A liquid container 5 with a spray mechanism 16 is fastened to the handle 8. The liquid container 5 is configured in such a way that it can be removably fastened to the spray mechanism 16. For this purpose, the spray mechanism 16 has a receiving mechanism 17, into which the liquid container 5 can be inserted. The spray mechanism 16 comprises a cylinder 18 integrated into the handle 8, in which a piston 19 is movably guided in a translatory manner. The cylinder 18 has an inlet channel 20, by means of which the cylinder 18 is connected to the liquid container 5. A valve 21, preferably a spring-loaded check valve, is located in the inlet channel 20. Furthermore, the cylinder 18 is connected to an outlet channel 22, at the free end of which a nozzle 23 is located. A further, spring-loaded valve 29 is located in the inlet channel 22. The piston 19 is also spring-loaded and, in the unloaded state, is located in the extended position. The cylinder 18 is filled with cleaning liquid. The piston 19 is connected by a linkage 30 arranged in the handle 8 to a lever 24, which is located in the grip 25 of the handle. If the lever 24 is actuated, the piston 19 moves into the cylinder 18 and, after exceeding a predetermined pressure, opens the further valve 29 and, after leaving the outlet channel 22, the cleaning liquid is atomised by the nozzle 23 and distributed as a fine mist on the floor to be cleaned. The piston 19 is surrounded by spring 31, which keeps the piston 19 in the unloaded state in the open position. Furthermore, the spring 31 allows the piston 19, after actuation, in other words closing, to move automatically into the open position and the cylinder 18 to be automatically filled with cleaning liquid. In this configuration it is advantageous that the spray mechanism can be actuated purely manually and that no auxiliary energy is required. Because of the piston/cylinder arrangement 18, 19 with the valves 21, 29, in contrast to the free discharge, however, a pressure is generated, by means of which the cleaning liquid can be atomised. As a result, the liquid requirement decreases as small quantities of detergent are sufficient for normal soiling. Furthermore, the area output of the cleaning device 1 increases as only a little cleaning liquid has to be received by the wiping cover 13. Thus it rarely has to be removed from the base body 2 to be wrung out.

Figure 6:
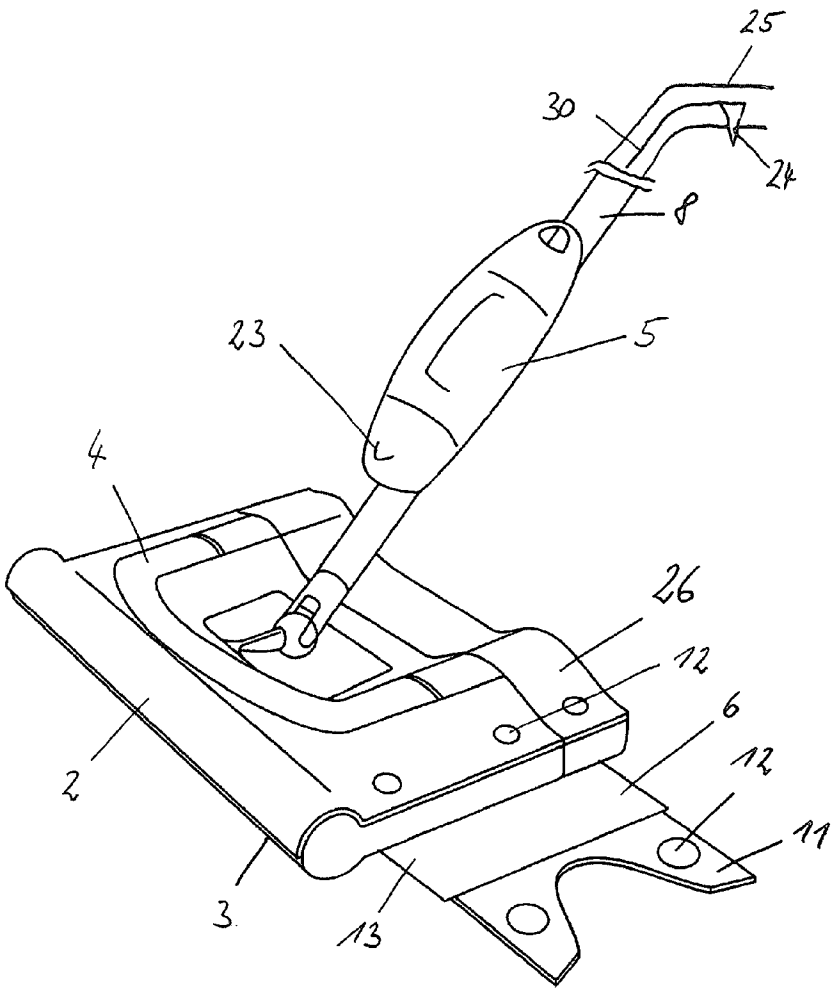
FIG. 6 shows a cleaning device with an extension which can be attached thereon.
Figure 6:
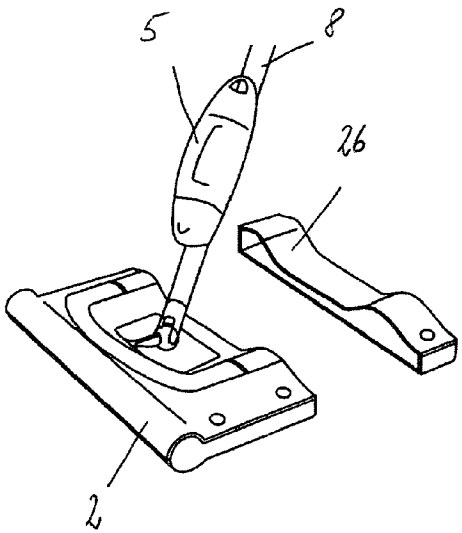

FIG. 6 shows a cleaning device 1 according to FIG. 5, an attachable extension 26 being fastened to the rear part of the base body 2 in order to be able to guide the mop cover 13 over its complete width below the base body. In this configuration it is advantageous that conventional commercial mop covers known from flat mops can be used. It is therefore not necessary to keep available various types of mop covers for damp mopping and for using on the cleaning device 1 according to the invention. The mop covers known from the German published application DE 10 2006 038 498 A1 can be considered, in particular, as mop covers.

Figure 7:
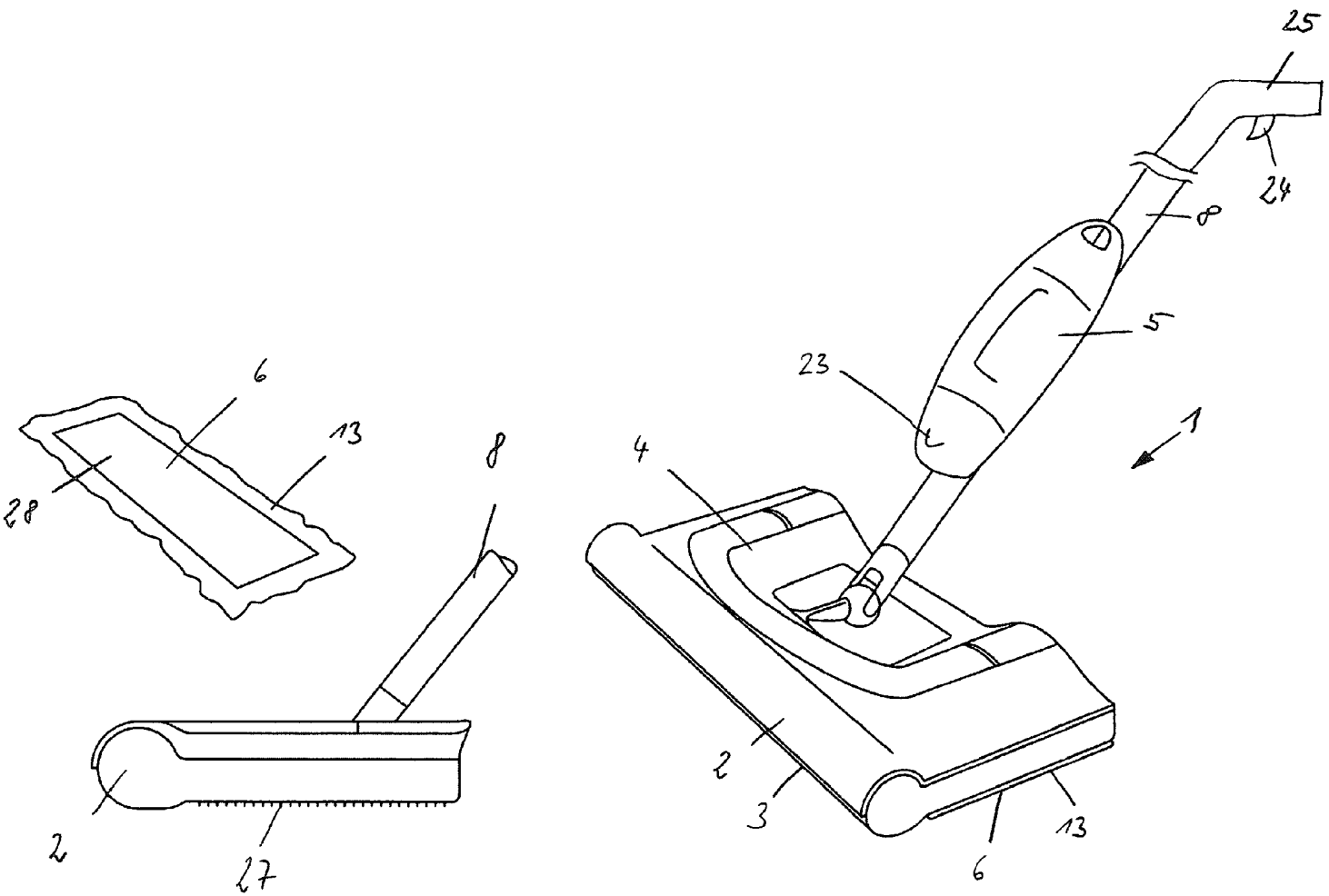
FIG. 7 shows a cleaning device with a mop cover which can be fastened by means of a hook-and-loop connection.

FIG. 7 shows a cleaning device 1 according to FIG. 5, the device 6, also configured as a mop cover 13 in this configuration, being fastened, on the side facing the floor to be cleaned, to the base body 2. The cloth holder is also dispensed with in this configuration. For fastening, the rear of the mop cover is provided with a fleece material 28 and the base body 2 is provided with a hook-and-loop material 27. Thus, the mop cover 13 is reliably, rapidly and easily releasably fastened to the base body 2. It is advantageous in this configuration that the mop cover 13 does not project beyond the base body 2 and is virtually invisible during cleaning. Furthermore, the mop cover may be fastened particularly easily.

Figure 8:
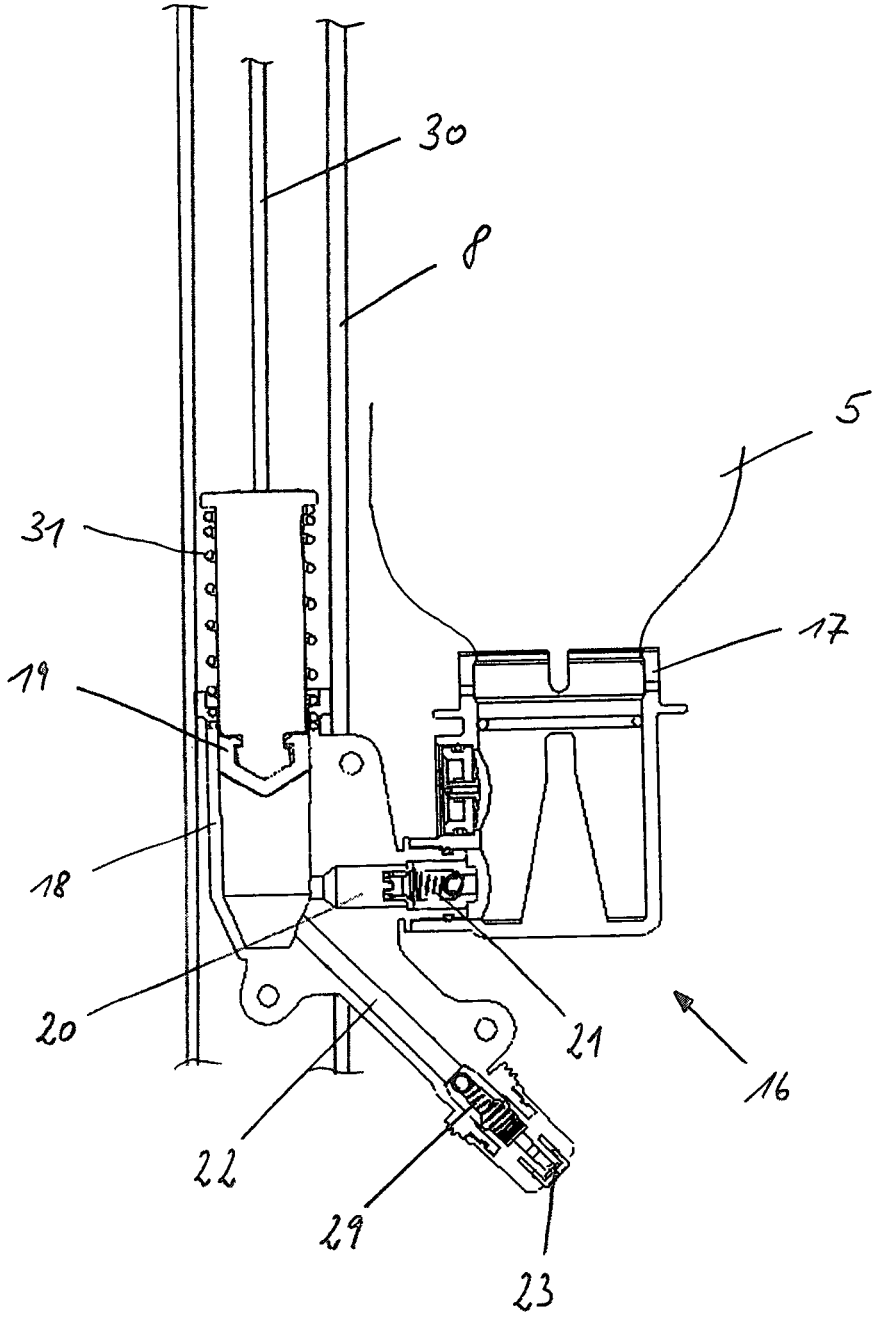
FIG. 8 shows, in detail, a spray mechanism fastened to the handle of the cleaning device.

FIG. 8 shows in detail the spray mechanism 16 described above. It is conceivable to provide the spray mechanism 16 on each of the above-described cleaning devices 1.

The invention claimed is:

1. A cleaning device for cleaning a floor, the device comprising:

a base body;

a rotatable roller brush disposed on the base body;

a dirt container disposed on the base body;

a liquid container configured to receive a cleaning liquid disposed on the base body;

a sponge configured to receive a soiled cleaning liquid disposed on the base body; and a fabric covering on a side of the sponge lacing the floor, wherein the base body includes a slot-shaped opening disposed on a side facing the floor, and wherein the sponge projects through the slot-shaped opening so as to contact the floor.

2. The cleaning device as recited in claim 1, wherein the sponge is removable.

3. The cleaning device as recited in claim 1, wherein the liquid container is connected to the roller brush such that the cleaning liquid is applicable to the roller brush.

4. The cleaning device as recited in claim 1, wherein the roller brush has a plurality of bristles including a material having a water absorption capacity.

5. The cleaning device as recited in claim 4, wherein at least some of the plurality of bristles include a wear indicator.

6. The cleaning device as recited in claim 4, wherein at least some of the plurality of bristles are treated with an antibacterial agent.

7. The cleaning device as recited in claim 1, wherein the roller brush is vertically displaceable on the base body.

8. The cleaning device as recited in claim 1, wherein the sponge is operatively connected to the dirt container.

9. The cleaning device as recited in claim 8, further comprising a perforated partition disposed between the sponge and the dirt container.

10. The cleaning device as recited in claim 1, wherein the sponge is an open-cell sponge.

11. The cleaning device as recited in claim 1, wherein the sponge comprises a polyurethane.

12. A cleaning device for cleaning a floor, the device comprising:

a base body;

a rotatable roller brush disposed on the base body;

a dirt container disposed on the base body;

a handle;

a liquid container configured to receive a cleaning liquid disposed on the handle;

a sponge configured to receive a soiled cleaning liquid disposed on the base body; and a fabric covering on a side of the sponge facing the floor, wherein the base bogy includes a slot-shaped opening disposed on a side facing the floor, and wherein the sponge projects through the slot-shaped opening so as to contact the floor.

13. The cleaning device as recited in claim 12, wherein the sponge is an open-cell sponge.

14. The cleaning device as recited in claim 12, wherein the sponge comprises a polyurethane.

15. A cleaning device for cleaning a floor, the device comprising:

a base body;

a rotatable roller brush disposed on the base body;

a dirt container disposed on the base body;

a liquid receiving device configured to receive a cleaning liquid disposed on the base body;

a mechanism configured to receive a soiled cleaning liquid disposed on the base body; and a fabric covering on a side of the mechanism facing the floor, wherein to base body includes a slot-shaped opening disposed on a side facing the floor, and wherein the mechanism projects through the slot-shaped opening so as to contact the floor.

16. The cleaning device as recited in claim 15, wherein the liquid receiving device includes a suction device.

17. The cleaning device as recited in claim 15, wherein the mechanism comprises a zeolite.

18. The cleaning device as recited in claim 15, wherein the mechanism comprises a silicate.

19. The cleaning device as recited in claim 15, wherein the mechanism comprises a chemical drying agent or a super-absorber.

* * * * *